US010718600B2

(12) United States Patent
Tamar et al.

(10) Patent No.: US 10,718,600 B2
(45) Date of Patent: Jul. 21, 2020

(54) SYSTEM FOR QUICK ARMING OF DETONATION OR EXCITATION ASSEMBLY

(71) Applicant: RAFAEL ADVANCED DEFENSE SYSTEMS LTD., Haifa (IL)

(72) Inventors: Michael Tamar, Karmiel (IL); Avraham Levi, Kibbutz Yehiam (IL); Lavi Vainshtein, Yoqneam Illit (IL)

(73) Assignee: Farael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 16/479,175

(22) PCT Filed: Jan. 21, 2018

(86) PCT No.: PCT/IL2018/050074
§ 371 (c)(1),
(2) Date: Jul. 18, 2019

(87) PCT Pub. No.: WO2018/134826
PCT Pub. Date: Jul. 26, 2018

(65) Prior Publication Data

US 2019/0368850 A1 Dec. 5, 2019

(30) Foreign Application Priority Data

Jan. 22, 2017 (IL) ..... 250231

(51) Int. Cl.
*F42C 15/40* (2006.01)

(52) U.S. Cl.
CPC ..... *F42C 15/40* (2013.01)

(58) Field of Classification Search
CPC ..... F42C 15/184; F42C 15/20; F42C 15/34; F42C 15/40
(Continued)

(56) References Cited

U.S. PATENT DOCUMENTS 3,313,236 A * 4/1967 Lohmann ..... F42C 15/188 102/256
4,478,147 A 10/1984 Hennings
(Continued)

FOREIGN PATENT DOCUMENTS

EP 2942597 A1 11/2015

*Primary Examiner* — Bret Hayes
(74) *Attorney, Agent, or Firm* — Rodney J. Fuller; Booth Udall Fuller, PLC

(57) ABSTRACT

A system for quick arming of a detonation or excitation assembly, wherein the system comprises a first barrier means which, as long as it has not been removed, prevents full activation of an initiation chain of the assembly, and whose removal is dependent on receiving indication from at least one first sensor, and then its removal is reversible in a manner that it will return and once again prevent full activation of an initiation chain, and a second barrier means which also prevents full activation of the initiation chain as long as it has not been removed, and whose removal is dependent on receiving indication from at least one second sensor, and this—following after receiving indication from the first sensor, and removal of the second sensor is irreversible in a manner that leaves the initiation chain executable, and wherein the first and second sensors are independent of one another, and as long as no indication has been received from the second sensor, the first barrier means is returnable to its place in a manner that will return and once again prevent full activation of the initiation chain, and an active protection system utilizing a plurality of those quick arming system for activation of the protection system's interceptors while implementing a method for quick and selective arming of the active protection system's detonation or excitation assemblies.

20 Claims, 9 Drawing Sheets

Figure 1:
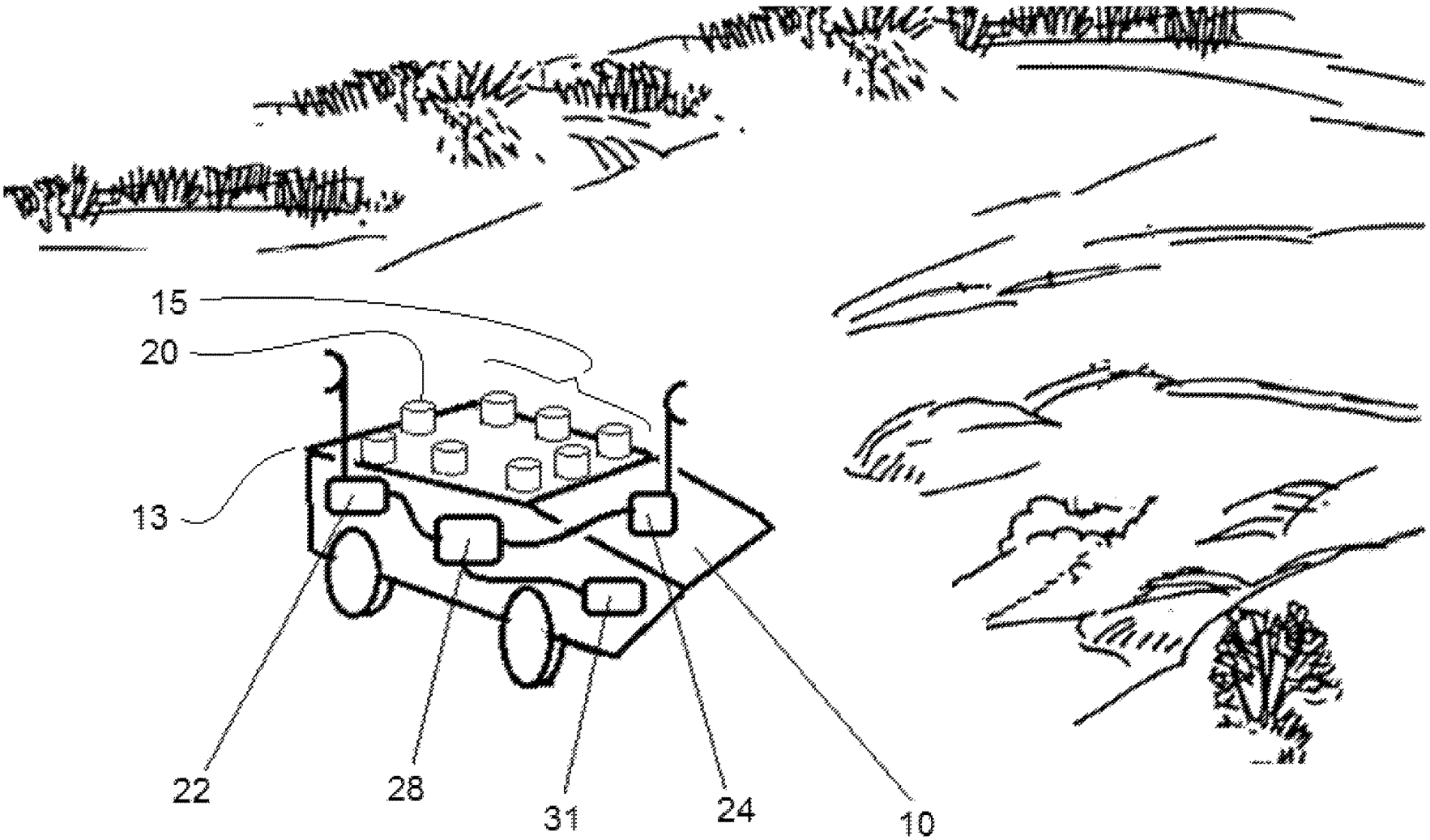

(58) Field of Classification Search
USPC ..... 102/222, 226, 254, 256
See application file for complete search history.

(56) References Cited

U.S. PATENT DOCUMENTS

| | | | | | |
|---|---|---|---|---|---|
| 4,667,600 | A * | 5/1987 | Jensen | F42B 10/56 | 102/254 |
| 4,727,809 | A * | 3/1988 | Watson | F42C 15/44 | 102/206 |
| 4,815,381 | A | 3/1989 | Bullard | | |
| 5,206,455 | A * | 4/1993 | Williams | F42B 3/113 | 102/201 |
| 5,375,525 | A * | 12/1994 | Greenslade | C06C 5/06 | 102/254 |
| 5,693,906 | A * | 12/1997 | Van Sloun | F42C 15/31 | 102/251 |
| 6,167,809 | B1 * | 1/2001 | Robinson | F42C 15/184 | 102/235 |
| 6,431,071 | B1 * | 8/2002 | Hodge | F42C 15/184 | 102/221 |
| 7,040,234 | B1 * | 5/2006 | Maurer | F42C 15/184 | 102/200 |
| 7,077,049 | B2 | 7/2006 | Shumov | | |
| 2008/0072781 | A1 * | 3/2008 | Sigler | F42C 15/192 | 102/251 |
| 2014/0214281 | A1 | 7/2014 | Welker | | |

* cited by examiner

SYSTEM FOR QUICK ARMING OF DETONATION OR EXCITATION ASSEMBLY

CROSS-REFERENCE TO RELATED APPLICATIONS

This application is the U.S. National Stage of International Application No. PCT/IL2018/050074, filed on Jan. 21, 2018, which claims the benefit of and priority to Israeli Application No. 250231, filed on Jan. 22, 2017, the contents of each of which are hereby incorporated by reference in their entireties.

FIELD OF THE INVENTION

The various embodiments described herein generally relate to systems for arming of detonation or excitation assemblies in preparation for their initiation in general (also known as "Safe and Arm Devices" or "SAD" or "S&A devices"), and such that enable arming as said, which is quick and selective—of a specific detonation or excitation assembly, one or more, which was chosen on short notice from a given array of numerous detonation or excitation assemblies, as said.

BACKGROUND OF THE INVENTION

Known and familiar are systems whose activation is obtained through initiation of detonation or excitation assemblies. An example of such systems is active protection systems which are used for protecting vehicles or sensitive sites from threats that are approaching them (for example—missile, bomb, rocket or shell during flight).

For example, in active protection systems, following after detection of a threat, there is need for a timely and quick launch of an interceptor. Examples of interceptors in such systems are an explosive charge for blast-effects, one or more mechanical component (such as a hit-to-kill kinetic striker or fragmentation or balls containing cluster-charges), or an explosively formed projectile. The interceptor's launch should be executed in high accuracy towards the approaching threat, in a collision course with it or at most, in a direction that will bring the interceptor to the immediate vicinity of the threat (in case that the interceptor is an active interceptor by itself).

Given the short periods of time during which all of the processes of identification, launch and arrival of the interceptor to the threat need to be accomplished, such systems are frequently based on detonation assemblies of explosives or excitation of propellant materials, for quick activation and energy production in a short period of time, thus launching the interceptor to a high acceleration flight, towards the approaching threat.

The need to provide peripheral and sectorial defense on the one hand, and the short time restrictions cited above, as well as the limited maneuverability and guidance capabilities of the various interceptor types (if existing at all) on the other hand, require, on occasion, deployment of an entire array of numerous detonation or excitation assemblies, as said, in a manner that enables activation of specific interceptors from the entire array, based on their preliminary association and direction towards sub-sectors, namely a specific section of the total sectorial defense.

Similarly, also when a single detonation or excitation assembly is used, there is often need to choose the optimal activation or excitation point (or several points of activation or excitation) out of a larger group of potential activation or excitation points, in order to achieve desired directionality of the detonation or activation action, or other useful effect, derived from an educated choice of the excitation point/points.

An active protection system, or any other system that uses activation or excitation as stated above, then faces the challenge to quickly assign the proper interceptors from the array, to the threat in their sector, and to bring about a quick and selective activation of same specific detonation or excitation assemblies, one or more, whose activation will lead to launch of interceptors suitable for facing the threat of the given sector, or to create the desired directionality or other useful effect, which depend on an educated choice of the excitation point/points.

Concurrently, we are dealing with, as said, systems that are based on explosives and thrust materials whose, detonation or excitation assemblies, as known, are based on an initiation chain—serial activation one after the other, of components that are arranged in an escalating order of power, yet in descending order of sensitivity (an example of a typical initiation chain—a detonator, a lead charge and a booster).

Known and familiar is a requirement for securing in a safe state of initiation chain, wherever it is, from unintentional actuation. That, by regular placement of barriers that prevent serial actuation of the components, by imposing physical discontinuations of the initiation or detonation chain, and are removable at the correct timing—from the instant of the system's arming (in order to enable proper operation of the full chain and activation of the explosive or the thrust materials by it). Systems that place such barriers are called 'detonation safety systems' or "Safe and Arm Devices" or "SAD" or "S&A devices".

Given an active protection system which includes numerous detonation or excitation assemblies as said, by nature of things, the system also includes a similar number of detonation safety systems.

All this and more, activation of an active protection system is dependent on detection sensors which detect the threat and its direction of flight. These are detection sensors which, based on the data received from them, enable the assigning, as said, the proper interceptors from the array, to the threat detected in their sector. In any case, as a condition for a quick and selective activation of only said specific detonation and excitation assemblies, one or more, whose activation will lead to launching the interceptors suitable for facing the threat of the given sector, it is required to remove, at the right timing, their detonation safeties. Similarly, this requirement also exists for other systems using activation or excitation of a single charge, but during an educated choice of potential activation/excitation points, to achieve desired directionality of the detonation or activation action, or other useful effect, derived from an educated choice of the excitation point/points.

In some occasions, the active protection system includes numerous sensors which are activated in a manner of detection "layers" (relative to the protected object), for the sake of high probability confirmation of the threat and estimation of the risk that it indeed poses (and in a manner that, by nature of things, reduces the amount of false alarms and the protective ammunition spent on intercepts).

Given a multi-layered array with numerous sensors as said, it is appropriate not to arm the entirety of the detonation or excitation assemblies of the array from the instant of receiving an initial alert alone, and in a manner that from then on, removes all of the detonation safeties from all of the initiation chains installed in the array, thus—exposing the entirety of the detonation or excitation assemblies of the array to risks of involuntary activation.

Thus, in the time that preceded the invention which is the subject matter of this patent application, professionals in the field were challenged to provide a technological solution that will enable quick arming of initiation or detonation assemblies in preparation for their optional initiation, in a manner that reduces their exposure to involuntary activation, and will be implementable in systems with numerous such initiation or detonation assemblies, in a manner that will provide arming ability as said, which is quick and selective—of a specific detonation or excitation assembly, one or more, which is chosen on short notice from the given array, which has, as said, numerous detonation or excitation assemblies.

SUMMARY OF THE INVENTION

The invention, subject matter of this patent application, enables quick arming of detonation or excitation assemblies in preparation for their optional initiation, in a manner that enables to reduce their exposure to risks of involuntary activation, and which is implementable in systems with numerous such activation or detonation assemblies, for example—active protection systems with numerous interceptors' activation centers, which are positioned in a sectorial array around the object for which protection is required (for example—a vehicle or position), and in its vicinity.

The arming process according to present invention is divided into multiple chronologic stages which are implemented by serially and selectively executed actions, at least one of which is a reversible action while at least one other is an irreversible action.

Implementation of systems for quick arming of detonation or excitation assemblies according to the invention, and systems with numerous activation centers as said, will provide an arming capability which is quick and selective—of a specific detonation or excitation assembly, one or more, which was chosen on short notice from the given array, which has, as said, numerous detonation or excitation assemblies.

Aspects and embodiments are directed to a system for quick arming of detonation or excitation assembly, that comprises one first barrier means which prevents full activation of the initiation chain as long as it has not been removed, and whose removal is dependent on receiving an indication from at least one first sensor, and its removal is reversible in a manner in which it will return to its place and prevent full activation of the initiation chain. The system also comprises a second barrier means which also prevents full activation of the initiation chain as long as it has not been removed, and whose removal is dependent on receiving an indication from at least one second sensor, and this—following after receiving indication from the first sensor, and wherein removal of said second barrier means is irreversible in a manner that leaves the initiation chain executable, and the system is armed for detonation or excitation. The system interfaces (for example—through control means), with the first and second sensors, which are independent from each other. Following after removal of the first barrier means, and as long as no further indication is received from the second sensor, the first barrier means is returned to its place in a manner that it is safe once again and thus prevents full activation of the initiation chain. In a preferred embodiment of the system, in accordance with the invention, the typical period of time passing from the instant of receiving an indication from the second sensor until the initiation chain is executable, does not exceed 1 millisecond.

A system, in accordance with the invention, also embodies in its manner of operation a method for quick and selective arming of a detonation or excitation assembly. A method that comprises the step of providing a detonation or excitation assembly that comprises initiation chain components, first barrier means which prevents full activation of the initiation chain as long as it has not been removed, and whose removal is reversible to its safe state in a manner in which it will return to its initial place and once again prevent full activation of the initiation chain, and a second barrier means which also prevents full activation of the initiation chain as long as it has not been removed, and whose removal is irreversible from its now armed state in a manner that leaves the initiation chain executable, and the system is armed for detonation or excitation. The method comprises, in addition, a step of removing the first barrier means from the instant of receiving indication from at least one first sensor, and through electro-mechanic or electronic means. The method also comprises the step of removing the second barrier means from the instant of receiving indication from at least one second sensor, and this—following after receiving indication from the first sensor, and through pyrotechnic or mechanical means.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE ACCOMPANYING FIGURES

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures:

FIG. No. 1 constitutes an illustration of an example of a protected object (vehicle), on top of which installed is an active protection system, which includes an array of numerous systems for quick arming of detonation or excitation assemblies, in accordance with the invention.

FIG. No. 2 constitutes a schematic view in perspective of an example of a system for quick arming of detonation or excitation assembly in accordance with the invention, in a safety-locked state—a state in which two barrier means are preventing activation of a detonation or excitation assembly.

FIG. No. 3 constitutes a schematic view in perspective of the system illustrated in FIG. No. 2 in a state after the removal of the first barrier means (in the illustrated example—reversible release of a primary pin shaped lock, through rotary electro-mechanical means), without removal of the second barrier means.

FIG. No. 4 constitutes a schematic view in perspective of the system illustrated in FIGS. No. 2 and 3 in an armed state—a state after the removal of the second barrier means (in the illustrated example—igniting a pyrotechnic driver charge which induces an irreversible movement of a slider component).

FIG. No. 5 constitutes a cross section schematic view of an arming arresting means installed in the system illustrated in FIGS. No. 2-4, and which is intended for trapping the slider component at the subsequent end of its travel. The arresting means is illustrated in its initial state prior to the beginning of the slider's movement.

FIG. No. 6 constitutes a cross section schematic view of an arming arresting means installed in the system illustrated in FIGS. No. 2-4. The arresting means is illustrated when trapping the slider in the final state of arming the system after the end of the slider's travel wherein the slider is trapped and locked following its full movement.

FIG. No. 7 constitutes an illustration of an example of a protected object (vehicle), on top of which installed is an active protection system, which includes an array of four systems for quick arming of detonation or excitation assemblies, in accordance with the invention, prior to threat detection wherein the systems are in a safe state, that is—at a safe state in which for each of the four systems, in accordance with the invention, activation is prevented by two barrier means.

FIG. No. 8 constitutes an illustration of an example of the protected object illustrated in FIG. No. 7, wherein its active protection system is in a state of threat initial detection, and in a manner that at this stage, requires an alert state achieved by removal of first barrier means (in a reversible manner), at least from some of the systems for quick arming of detonation or excitation assemblies, installed in the protection system (in the illustrated example—in two out of four systems).

FIG. No. 9 constitutes an illustration of an example of the protected object illustrated in FIG. No. 8, at a state comprising the confirmation of the perceived threat to the protected object, estimation of the predicted flight trajectory towards the protected object as well as the predicted impact strike location of the threat at the protected object and relative to the array with numerous systems (in the illustrated example—four systems), for quick arming of detonation or excitation assemblies which are installed in the protection system, in a manner that requires at this stage, a full arming state by removal of the second barrier means (in an irreversible manner), but in one of the two systems earlier activated according to the illustrated example (see FIG. No. 8), the first barrier means was removed, while in the second of the two systems the first barrier means returns to its safe place. Namely—arming and selective removal—but in the same specific systems intended to challenge the threat by activating the interceptors against it (in the illustrated example—but one of the four systems), while the rest of the systems may stay safe and/or can be safe once again, by returning the first barrier means in each one of them to its place (in the illustrated example—returning in one out of two systems from which it was originally removed while the third and the fourth remain unchanged in there safe state (in the example illustrated in FIG. No. 8)).

DETAILED DESCRIPTION OF A PREFERRED EMBODIMENT

It is to be appreciated that embodiments of the and apparatuses and method discussed herein are not limited in application to the details of construction and the arrangement of components set forth in the following description or illustrated in the accompanying drawings. The apparatuses and methods are capable of implementation in other embodiments and of being practiced or of being carried out in various ways. Examples of specific implementations are provided herein for illustrative purposes only and are not intended to be limiting. In addition, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Referring to FIG. 1, there is illustrated an example of a protected object (in the illustrated example—vehicle 10), on top of which installed is an active protection system 13, which includes an array 15 of numerous systems 20 for quick arming of detonation or excitation assemblies, in accordance with the invention.

Any professional will understand that in the embodiment according to which, several systems for quick arming in accordance with the invention, as in the example of systems 20, are implemented in the active protection system, then—implementation of the arming systems enables the subjugation of the systems to detection sensors which are usually installed in protection systems of this sort. First 22 and second 24 sensors are illustrated in the illustrated example.

Any professional will understand that first 22 and second 24 sensors might be, as said, threat detection sensors from the kind that is usually installed in active protection systems (for example—radar type sensors, infrared detectors, optical cell arrays and ballistic-impact contact net shaped sensors). Sensors in such systems are usually operated as independent sensors. For example—the first sensor is radar for detection of far range threats, and the second sensor is an array of photoelectric cells positioned along and in proximity of the object for which protection is required, for detection of near range threats.

In accordance with the illustrated example and as customary in such protection systems, sensors 22 and 24 are linked between themselves through a central control system 28. The initial activation of the protection system is controlled by a central controlling component (not illustrated), and is supplied with activation power charge from an energy source, for example—from at least one electric capacitor 31.

The defended object (in the illustrated example—vehicle 10), is equipped with several means to intercept threats (which are not illustrated), which are linked for execution through systems 20. Each of the interception means is intended to implement active protection in the activity sector that constitutes a part of the area surrounding the protected object.

On these applicative embodiments we will elaborate further on, referring to FIGS. No. 7-9.

Reference is made to FIGS. No. 2-4, which constitute a schematic illustration of an example of system 20 in accordance with the invention.

Figure 2:
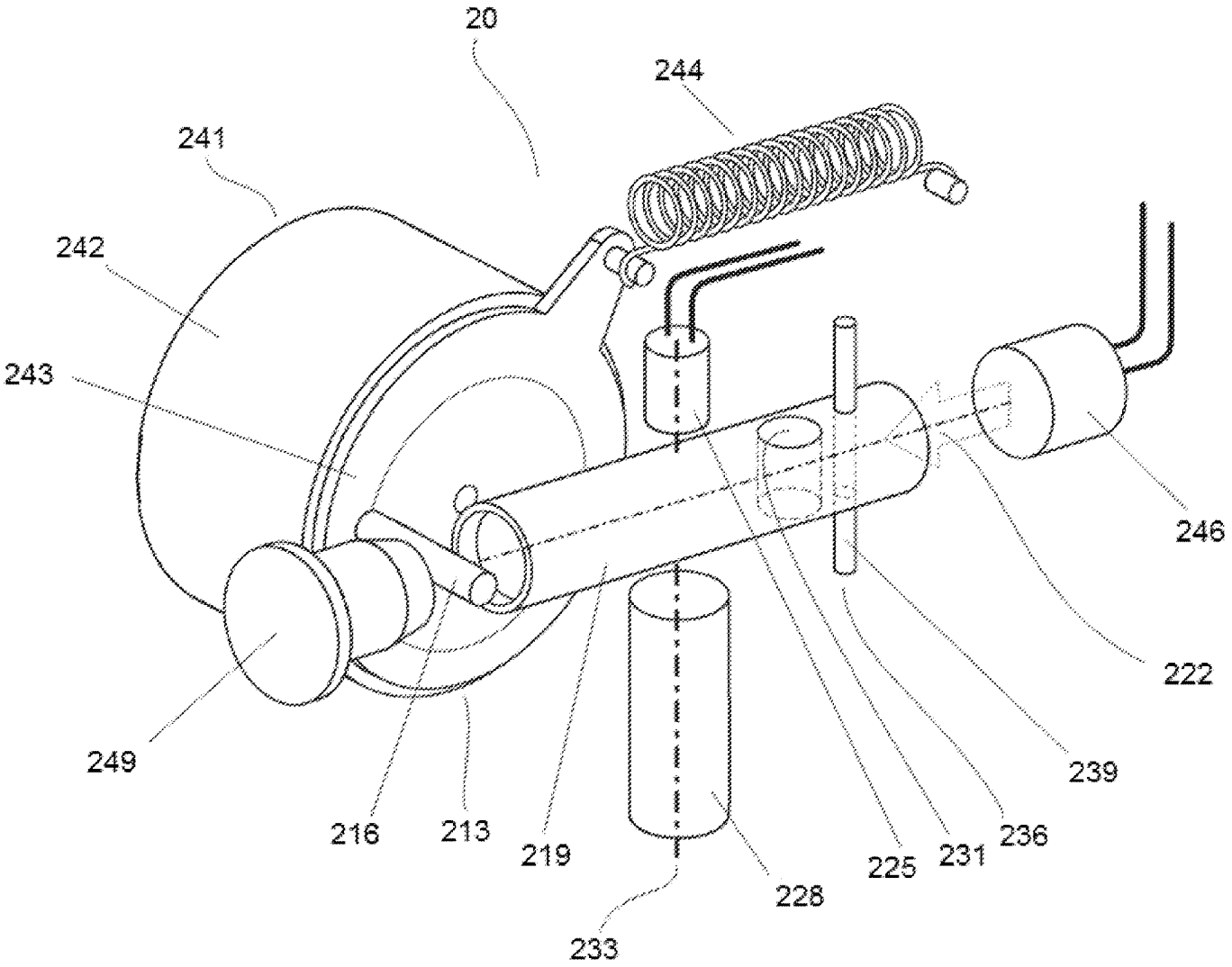

Referring to FIG. 2, there is illustrated a schematic view in perspective of an example of a system 20 for quick arming of detonation or excitation assembly in accordance with the invention, in a safety-locked state—a state in which two barrier means 213 and 236, on which we will elaborate hereinafter, are preventing initiation of a detonation or excitation assembly.

System 20 comprises a first barrier means 213. In the illustrated example—a primary pin shaped barrier 216, which is illustrated maintaining the safety-locked state of system 20 (as illustrated in FIG. No. 2), is standing in the way of a movable component—slider 219. In the illustrated example, slider 219 is designed as a movable component as said, which is designed in a piston-like configuration, linearly movable in the direction of the arrow 222. In a safety-locked state, the body of the slider 219 is separating between the components of the detonation or excitation assembly—in the illustrated example, separating by positioning a barrier between a detonator 225 and a booster 228, as well as shifting away detonation lead charge 231. Any professional would understand that the subject is the interruption of a detonation chain—activation of a detonator 225 in this geometric state, will not lead to fulfillment of an initiation chain—booster 228 will not be initiated due to the mechanical barrier imposed by the body of the slider 219 between them. Lead charge component 231 that is also a part of the detonation or excitation assembly, is positioned inside the body of slider 219, but in the illustrated state, it is located in a position which is distanced (an off-line position) from the common axis 233, on top and under which normally located are detonator 225 and booster 228.

Hence, a condition for the fulfillment of a detonation chain is providing an option for movement of slider 219 in a manner that will bring lead charge 231 to be located in-line—in common axis 233 as well. However, as said, in the illustrated example, from the beginning, pin 216 blocks the course of movement of the slider 219, thereby—prevents full activation of the initiation chain as long as it has not been removed from its way.

As it will be clarified further, from the instant of implementing system 20 in an active protection system, removal of pin 216 from the path of slider 219, is dependent on receiving indication from at least one first sensor (which is not illustrated), and then its removal is reversible in a manner that it will enable to once again prevent full activation of the initiation chain, if and from the moment its return to its initial place.

This and more, removing pin 216 from the path of slider 219 is a mandatory non-exclusive condition for the fulfillment of a detonation chain. System 20 comprises a second barrier means 236. In the illustrated example—shear pin 239, which in a safety-locked state of the system 20 (as illustrated in FIG. No. 2), affixes the body of slider 219 to the body (which is not illustrated), thereby, shear pin 239 is also preventing full activation of the initiation chain as long as it does not shear (only from the instant of shearing can slider 219 move and bring the lead charge 231 to be located in common axis 233).

As it will be explained hereinafter, shearing the shear pin 239, thereby removing affixation of slider 219, is an act which is dependent on receiving indication from at least one second sensor (which is not illustrated), and this—following after receiving indication from the aforementioned first sensor. All this and more, removing the affixation of slider 219 from the instant of shearing the pin 239, is an irreversible act which necessarily leads to shifting the lead charge 231 to a location in common axis 233, namely—leads to a state wherein the initiation chain is executable, and system 20 will therefore be armed for detonation of excitation.

According to the illustrated example, electro-mechanical means 241 is enabling the removal of pin 216 from the designated movement path of slider 219. This, in a manner that enables returning pin 216 to its place (as long as shear pin 239 has not been biased to shear yet). Electro-mechanical means 241 might be, according to the illustrated example, a rotary solenoid assembly 242 further featuring a return spring 244, wherein pin 216 is installed as an integral part on top of the rotating element 243 of the solenoid assembly, while it protrudes from it into the designated movement path of slider 219.

Reference is made to FIG. No. 3. FIG. No. 3 constitutes a schematic view in perspective of the system illustrated in FIG. No. 2 in a state of after the removal of the first barrier means. In the illustrated example—reversible release of a primary pin shaped lock 216, as was through activation of electro-mechanical means 241 in the form of a rotary solenoid assembly 242.

Any professional would understand that switching into electrical power supply to solenoid 242, will lead to a reversible removal as said of first barrier means 213—rotational movement of element 243, thus shifting pin 216 in the illustrated example, out from the intended movement path of slider 219. While, re-switching into off state wherein the electrical power supply to solenoid 242 is stopped, will result in return by spring 244 force, of first barrier means 213—pin 216 in the illustrated example, automatically back to its initial place (as depicted in FIG. 20 in a manner as said, that the system's first barrier means, once again, will act as the major locking that prevents full activation of the detonation chain.

Any professional would appreciate the fact that the choice of an electro-mechanical means specifically as a spring-armed rotary solenoid, might provide durability advantages to the system 20 during exposure to harsh environmental conditions—a rotary solenoid is regularly balanced around a rotation axis, therefore it is not prone to being released due to exposure to mechanical shocks or vibrations. It is but expected that system 20 will be exposed to harsh environmental conditions during its operational life from the moment of its implementation, according to the implementation example we repeatedly refer to, in an active protection system. System 20 might then be exposed to shock waves in its immediate surroundings (for example—product of explosions), and to vibrations at different frequencies (for example—product of terrain-induced stress or of the road condition, on which the protected vehicle, on top of which installed is an active protection system, wherein system 20 is implemented, moves). However, any professional would understand that we are solely presenting an example, and removal of first barrier means in systems in accordance with the invention, might be accomplished in a reversible manner as required, through other and different means (for example—linear solenoid, electrically-movable bi-directional solenoid, helical screw based drive mechanisms).

Any professional would understand that in the embodiment, according to which systems for quick arming in accordance with the invention, as in the example of system 20, are embedded with active protection systems, then—as long as no indication was received from the second sensor, first barrier means 213, might be returned to its place in a manner that, as said, it will once again prevent full activation of the initiation chain.

However, as long as an indication is indeed received from the second sensor as well, then—system 20 needs to move the lead charge 231 to a location in common axis 233, namely—bring about in a very short time (as a consequence of the system being an active protection system, which is challenged to face dynamic approaching threats). A very short time might such that does not exceed 1 millisecond.

Reference is made to FIG. No. 4. FIG. No. 4 constitutes a schematic view in perspective of system 20 in an armed state—a state of after the removal of the second barrier means 236. In the illustrated example—igniting an irreversible movement of a slider component 219 through activation of a pyrotechnic thrust means 246.

As said, as a consequence of system 20 being installed in an active protection system, which is challenged to face dynamic approaching threats, from the moment of verifying the relevancy of the threat as such, system 20 is required to transfer to an armed state in a very short time. In order to overcome the short time "window" restriction, pyrotechnic thrust means 246 is implemented for irreversible removal of second barrier means 236. According to the illustrated example—shearing of shear pin 239 and biasing slider 219 to movement in the direction of arrow 222, and in a manner that brings the lead charge 231 to be located in common axis 233; as a consequence, the explosive train is now arranged uninterrupted, with all its components in-line.

Any professional would understand that pyrotechnic thrust means 246 might be made of an electrically powered pyrotechnic thrust unit. The movement of slider 219 will not be possible given an unintentional activation of such a pyrotechnic thrust unit, since first barrier means 213 (pin 216 in the illustrated example) will then stand in the way of slider 219, thus preventing arming of the system. However, from the instant of removing first barrier means 213 (and see FIG. No. 3—from the instant of switching rotary solenoid 242 to a state of receiving electric charge), activation of pyrotechnic thrust unit will provide sufficient energy to shear pin 239 (second barrier means 236 in the illustrated configuration), and for quick shifting of slider 219 to a state wherein lead charge 231 is to be located in common axis 233 so as to obtain an uninterrupted explosive train with all its components in-line.

Any professional would understand that as a consequence of activating pyrotechnic thrust means, a powerful, sharp and quick movement of the slider occurs, in a manner that might cause excessive movement or recoiling of the slider from the moment of its bumping with the end of its path. Hence, in order to guarantee preservation of lead charge 231 when it is located in the common axis 233, system 20 includes an arming arresting means 249.

Figure 3:
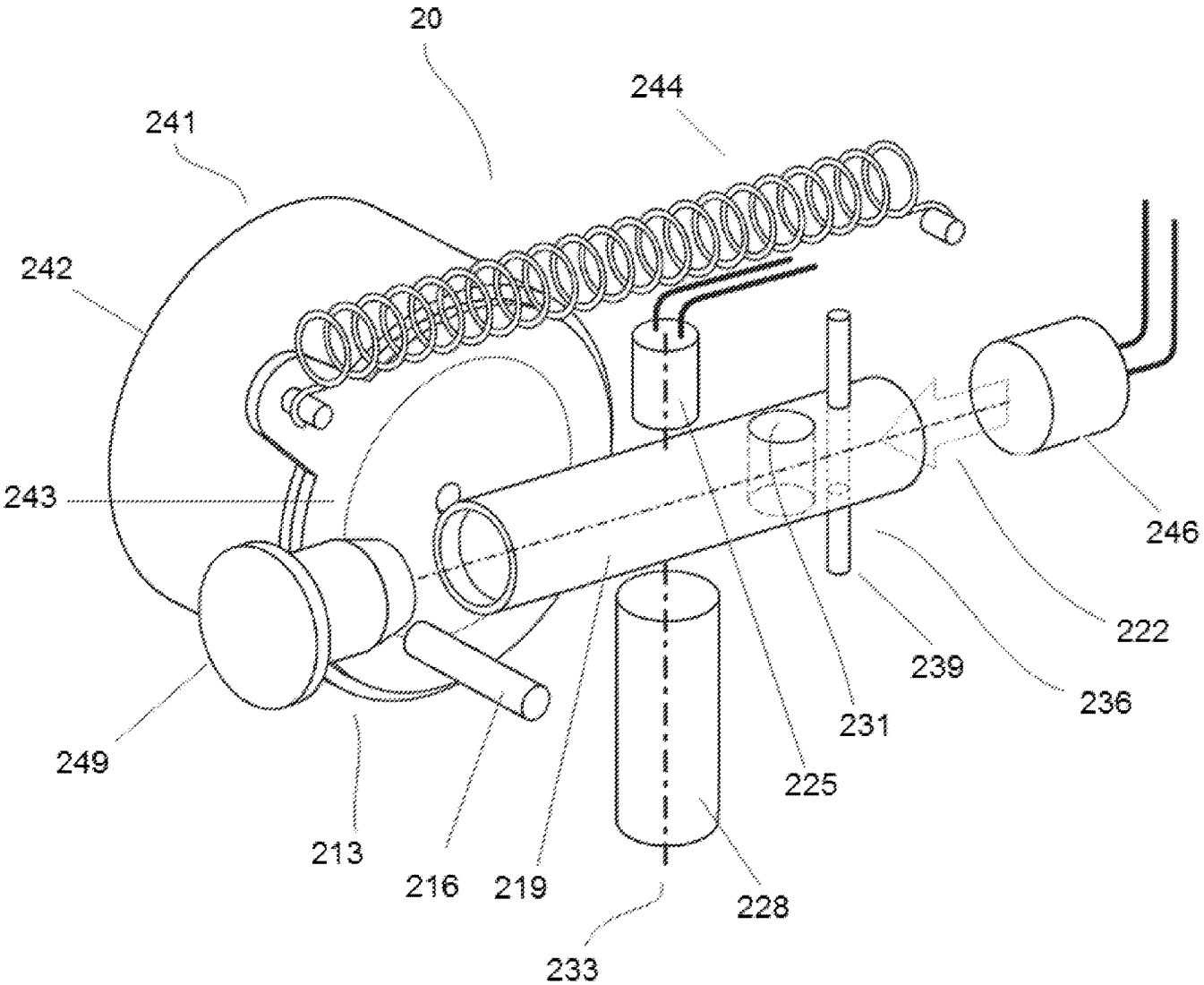
Figure 4:
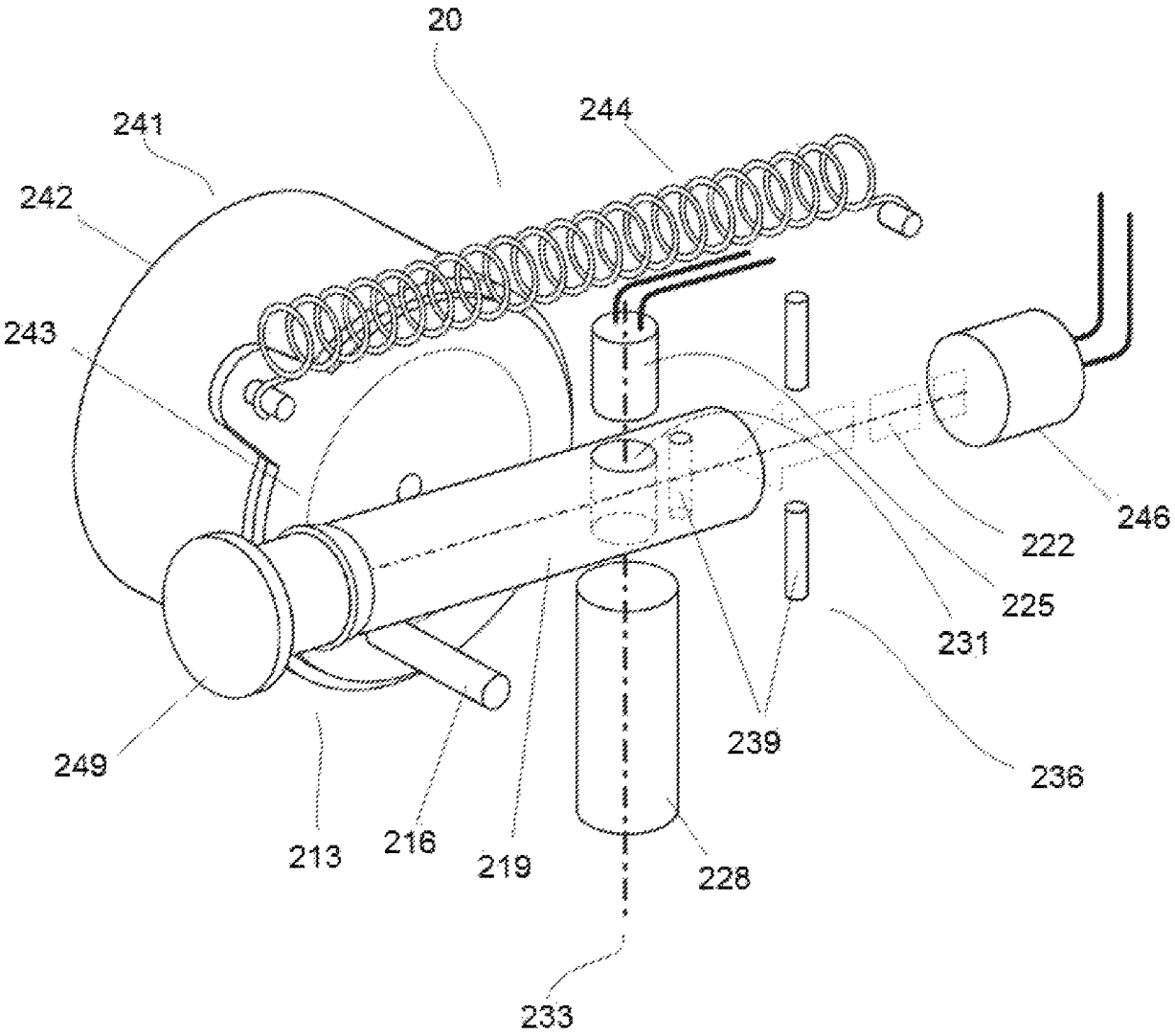
Figure 5:
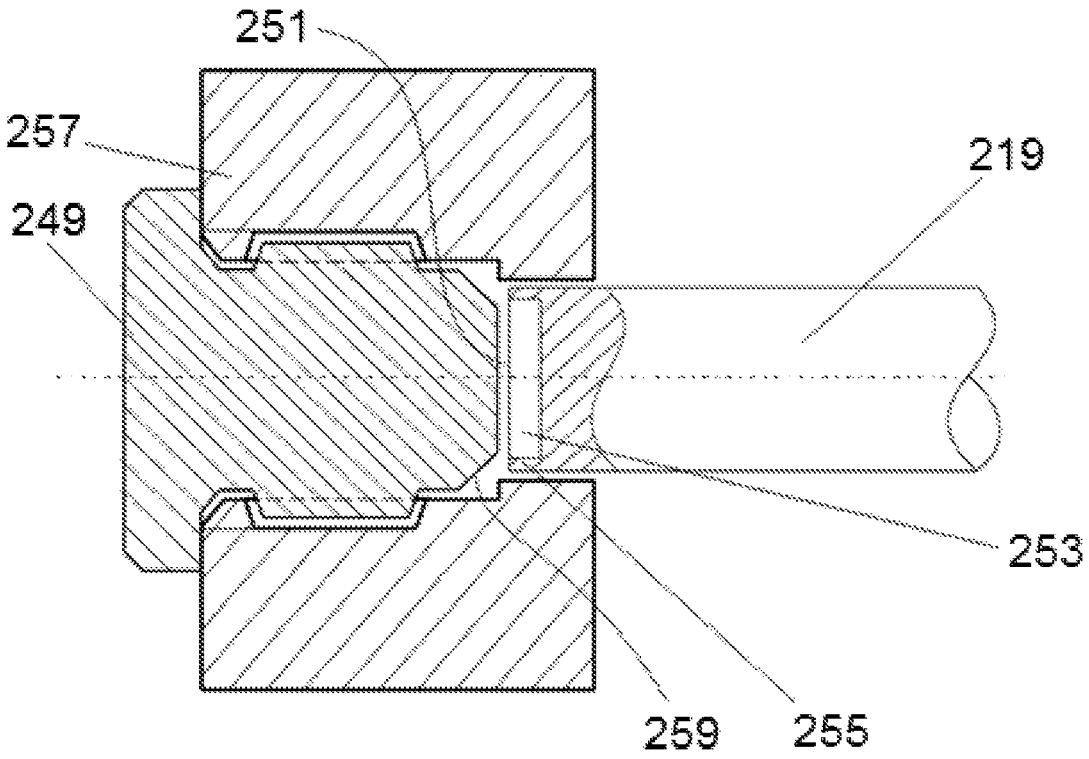
Figure 6:
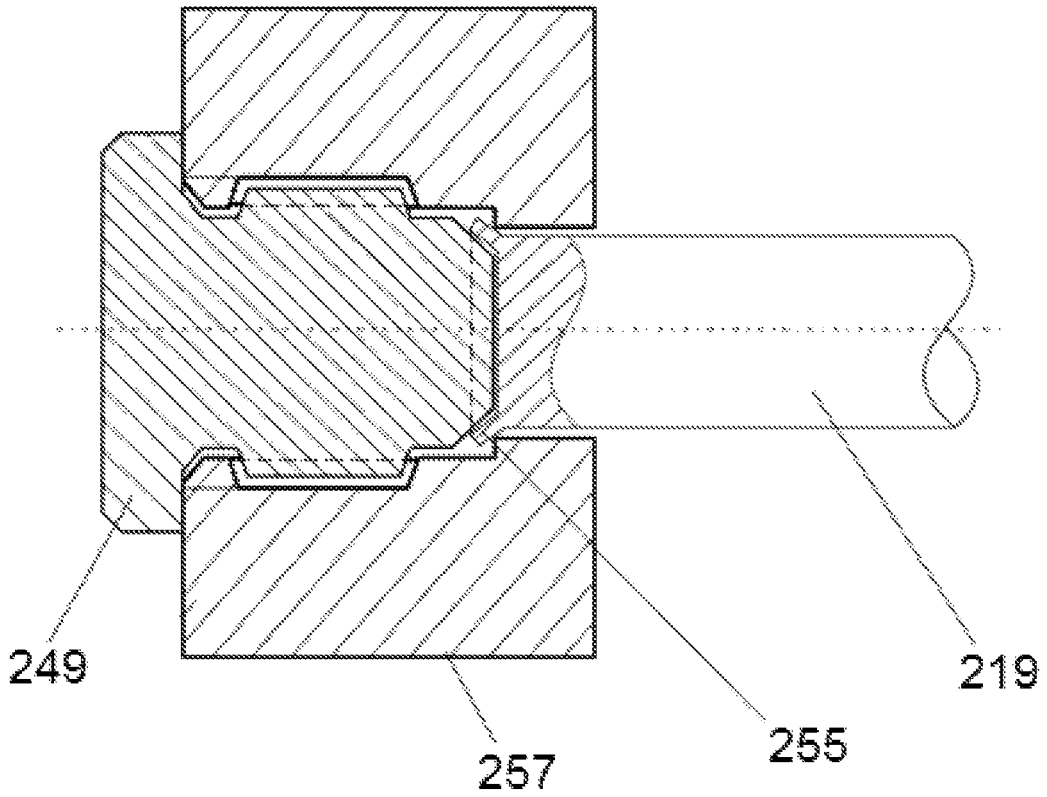
Figure 7:
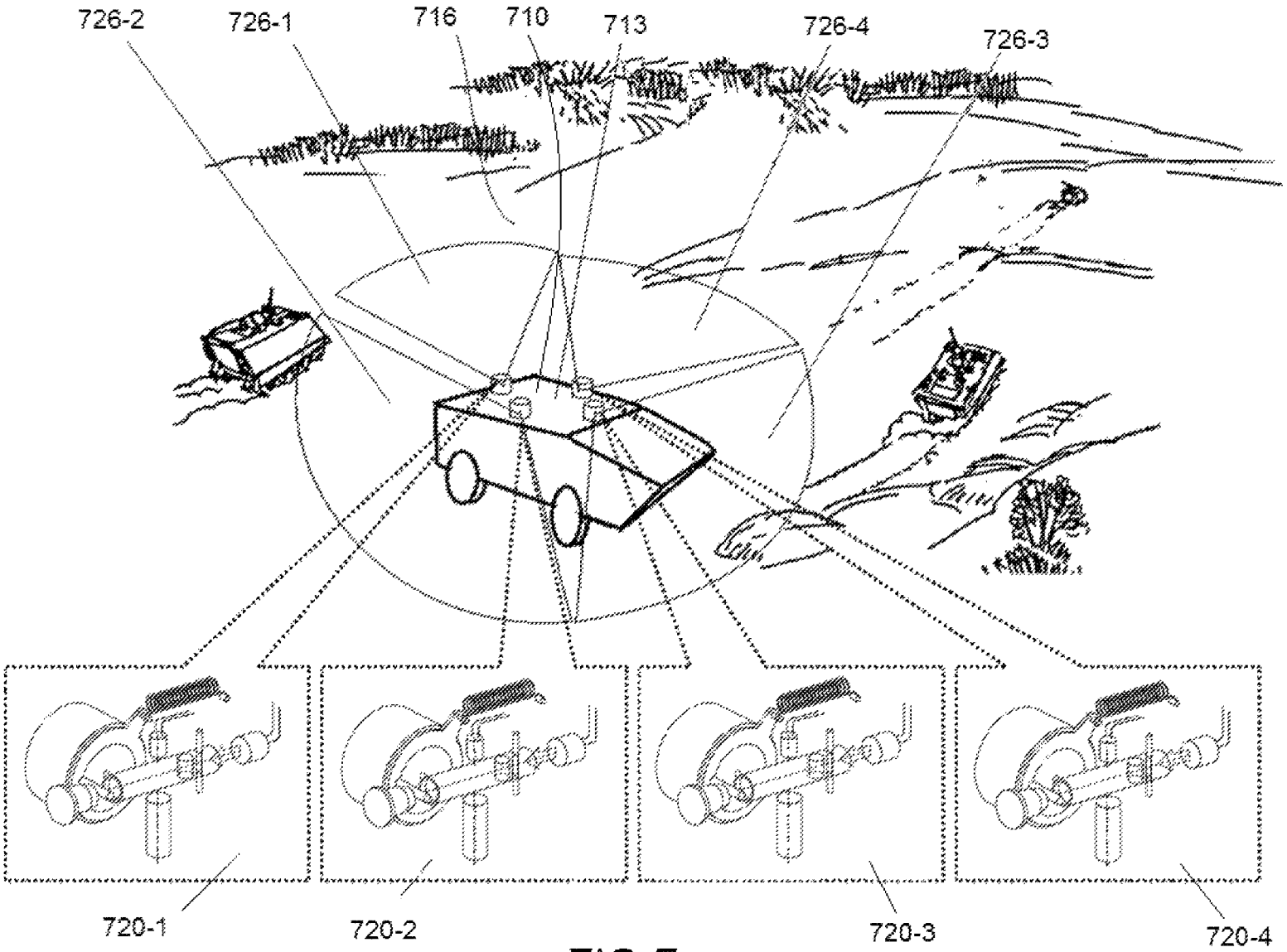
Figure 8:
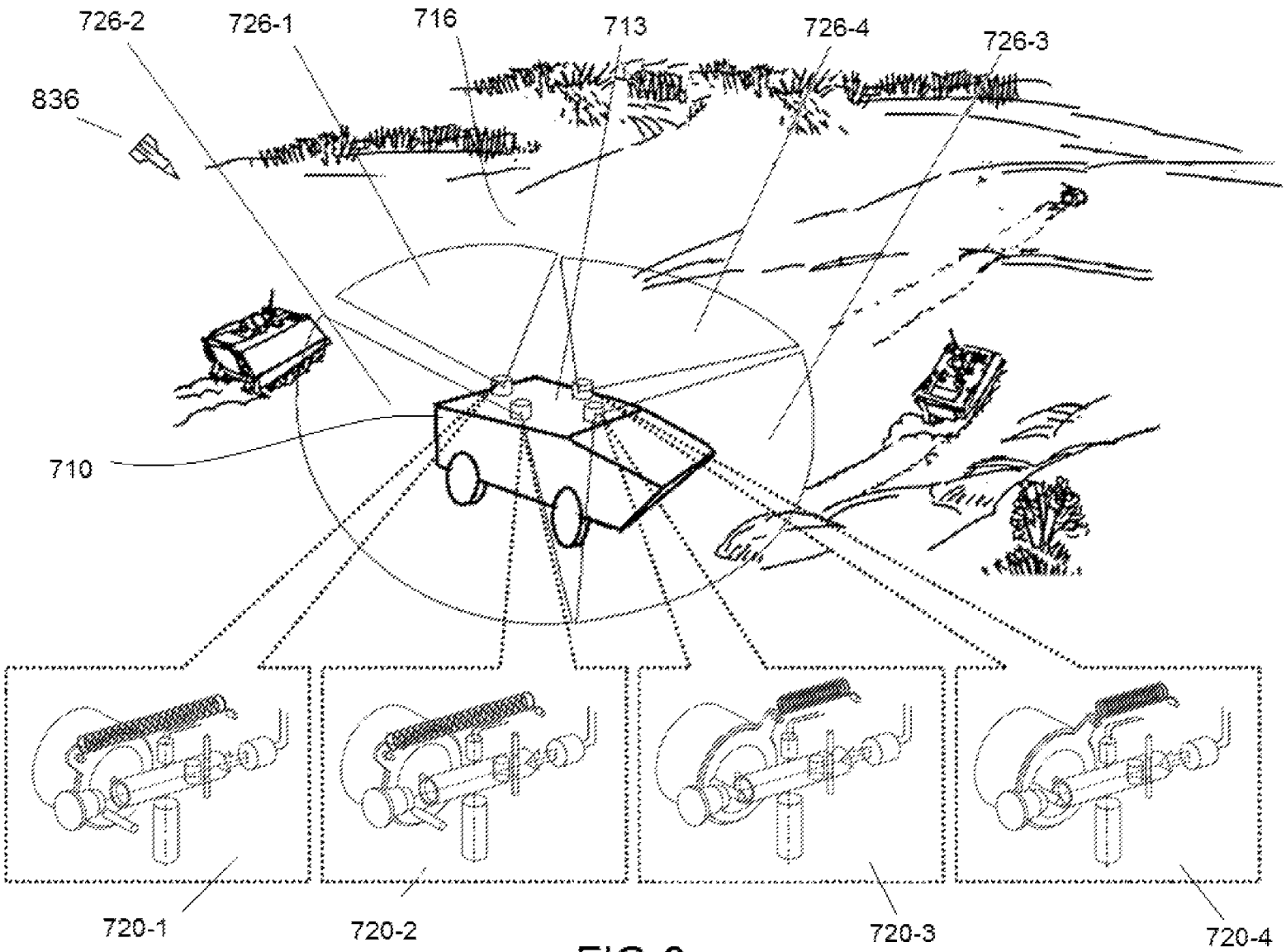
Figure 9:
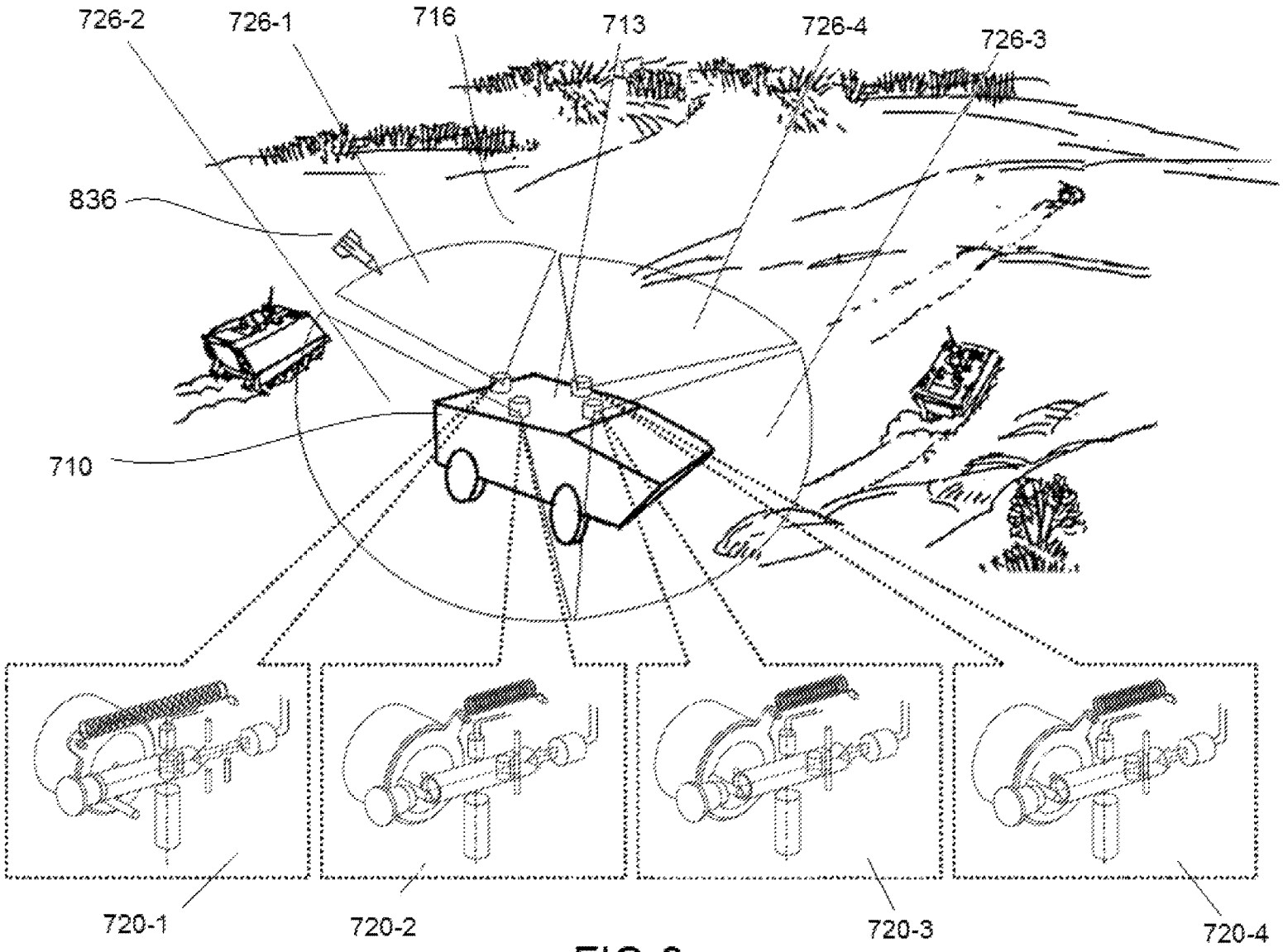

Reference is made to FIGS. No. 5 and 6. Following FIG. 2-4 and while relating to the elements depicted in those figures, FIGS. No. 5 and 6 constitute cross section schematic views of an example of an arming arresting means 249 installed in the system 20 and guarantees the arresting and trapping of slider component 219 at the end of its travel after its initiation to movement, in a location suitable as required for the fulfillment of an initiation chain. Arming arresting means 249 prevents excessive movement or recoiling of slider 219, after its initiation to movement by activating pyrotechnic thrust means 246. Arming arresting means 249 ensures the location of lead charge 231 in-line with detonator 225 from the one side, and booster 282 from the other side, as illustrated in FIG. No. 4, and as required for the fulfillment of a detonation chain. In FIG. No. 5, arming arresting means 249 is illustrated in its initial state prior to the beginning of slider's 219 movement. In FIG. No. 6 arming arresting means 249 is illustrated in its final state of arming system 20 after the end of slider's 219 travel wherein the deformation of the slider's tip (front end) arrested and trapped it into arresting means 249.

According to the illustrated example slider 219, which, as said, is designed in a movable piston-like configuration, is designed in its front end 251, which is leading in the direction of movement (direction of arrow 222), with inner space 253 in a manner that leaves relatively thin rim shaped margins 255 formed around its circumference. Arming arresting means 249 is designed as a bushing which is affixed to the assembly's housing 257, directed towards the front edge 251 of slider 219, with a conical beak shaped tip 259 for blind-mating with the slider's tip and deforming it.

As illustrated schematically in FIG. No. 6, from the moment of flinging margins 255 onto base 259, the margins 255 are stretched while being twisted and rolled up in plastic deformation to a "mushroom" like configuration; in a manner that slider 219 is "trapped" by arming arresting means 249.

Any professional will appreciate the fact that arming arresting means 249 implements in its manner of operation a known technique of a "bullet trap" as used in guns. However, we are solely presenting an example, and other and different means can be implemented for the preservation of a slider component of the system in accordance with the invention, after forcing it to movement, in the appropriate location, as required as said, for the fulfillment of an initiation chain.

Any professional would understand that in the manner of operation of system 20, is also expressed a general method for quick arming of a detonation or excitation assembly. A method that comprises the steps of providing a detonation or excitation assembly that includes initiation chain components (in the illustrated example—detonator 255, lead charge 231 and booster 228), first barrier means (pin 216), which prevents full activation of the initiation chain as long as it has not been removed, and its removal is reversible in a manner that it will return and once again prevent full activation of an initiation chain, and a secondary barrier means (shear pin 239), which also prevents full activation of the initiation chain as long as it has not been removed, and its removal is irreversible in a manner that leaves the initiation chain executable, and the system is armed for detonation or excitation (see FIGS. No. 2-4). An additional step of removal of the first barrier means from the instant of receiving indication from at least one first sensor, and through electro-mechanical means (solenoid 242), (see FIG. No. 3). And an additional step of removal of the second barrier means from the instant of receiving indication from at least one second sensor, and this—following after receiving indication from first sensor, and through pyrotechnic means (pyrotechnic thrust unit 246), (see FIG. No. 4).

As said, and as described hereinabove when referring to FIG. No. 1, an optional embodiment of systems for quick arming of detonation or excitation assemblies in accordance with the invention, is found in the field of active protection. We will need to return to such an embodiment example with reference to FIGS. No. 7-9 (yet any professional would understand that we are solely presenting an example, and systems in accordance with the invention, might also be used in other systems that require quick selective arming of detonation or excitation assemblies).

Reference is made to FIGS. No. 7-9. FIG. No. 7 constitutes an illustration of an example of a protected object (vehicle 710), on top of which installed is an active protection system 713, which according to the illustrated example, includes an array of four systems for quick arming of detonation or excitation assemblies, in accordance with the invention—720-1, 720-2, 720-3 and 720-4, at a safe state prior to threat detection, that is—at a state in which for each of the four systems, in accordance with the invention, activation is prevented by two barrier means. According to the illustrated example, the systems for quick arming of detonation or excitation assemblies, in accordance with the invention, were implemented in a peripheral multi-sectorial array 716. In FIG. No. 7 presented is a protected object 710, whose surrounding area was divided to four sectors which were tagged as 726-1, 726-2, 726-3 and 726-4, wherein one system for quick arming was assigned to each one of the sectors. In the state presented in FIG. No. 7, sectors 726-1, 726-2, 726-3 and 726-4 are not perceived as being at risk to be hit by any threat. Therefore, 720-1, 720-2, 720-3 and 720-4 are illustrated as being each in a safety-locked state—a state in which two barrier means are preventing initiation of a detonation or excitation assembly (see and compare with FIG. No. 2).

FIG. No. 8 constitutes an illustration of an example of the protected object 710 illustrated in FIG. No. 7, wherein its active protection system 713 is in a state of threat detection (in the illustrated example missile 836), and in a manner that at this stage, requires removal of first barrier means (in a reversible manner), at least from some of the systems for quick arming of detonation or excitation assemblies, installed in the protection system (in the illustrated example—in two out of four systems).

According to the illustrated example, at this stage of threat approach, sectors 726-1 and 726-2 are the ones that are at risk of being hit by the threat (for example—according to the data from a long range detection sensor (which is not illustrated)), thus in systems 720-1 and 720-2, and only in them, removal of first barrier means in a reversible manner occurred as a possible preparation for their full arming later on (see and compare with FIG. No. 3). Sectors 726-3 and 726-4 are not perceived in the illustrated example as being at risk of being hit by threat 836. Therefore, systems 720-3 and 720-4 remain in a safety-locked state (see and compare with FIG. No. 2).

FIG. No. 9 constitutes an illustration of an example of the protected object 710 illustrated in FIG. No. 8, at a state comprising the confirmation of the perceived threat to the protected object (in the illustrated example missile 836), calculation of estimation of the predicted impact strike location of the threat at the protected object took place (arrival of the threat from sector 726-1), and a decision was taken as to selective activation relative to the array with plurality of systems (in the illustrated example—four systems), for quick arming of detonation or excitation assemblies which are installed in the protection system, in a manner that requires at this stage, removal of the second barrier means (in an irreversible manner), but in one (in system 720-1) of the two systems according to the illustrated example (see FIG. No. 8), the first barrier means was earlier removed (in systems 720-1 and 720-2), while in the second (system 720-2) of the two systems the first barrier means returns to its place and the system returned to its safe state. Namely—selective removal is illustrated—but in the same specific systems intended to challenge the threat by activating the interceptors against it (in the illustrated example—but one of the four systems), while the rest of the systems remain in their safe state or can be secured to safe state once again, by returning the first barrier means in each one of them to its place (in the illustrated example—returning in one out of two systems from which it was originally removed (in the example illustrated in FIG. No. 8)). According to the illustrated example, but system 720-1 is brought to a state of full arming, in a manner that it is ready to challenge threat 836 in its sector, by activating interceptors (which are not illustrated), and therefore, system 720-1 is fully and irreversibly armed. Sector 720-2 which previously, was also perceived as being under possible threat according to data from a long range detection sensor (see FIG. No. 8), turned out at a later stage, illustrated in FIG. No. 9, as not being threatened according to data from the short range detection sensor. Therefore, the initial reversible arming of system 720-2 has been cancelled and it has been returned to a safety-locked state. Sectors 726-3 and 726-4 are still not perceived in the example as being at risk of being hit by the threat, and therefore, systems 726-3 and 726-4 remain as they were—in a safety-locked state.

Active protection system 713 as described hereinabove referring to FIGS. No. 7-9, comprises as said, a multi-sectorial array 716, that is—with numerous systems for quick arming of detonation or excitation assemblies, wherein each one of them is of the type described hereinabove when referring to FIGS. No. 2-6. However, any professional would understand that we are solely presenting an example, and an active protection system may include fast arming systems as said, which are similar and equivalent.

Any professional would understand that active protection system 713 includes interceptors (which are not illustrated), which are operated by array 716 and wherein each of the interceptors is assigned to at least one of the systems for quick arming and is executable by it.

Any professional would also understand that systems for quick arming, in accordance with the invention, might initiate detonation or excitation assemblies as said, in a manner that initiation on their part will be achieved in an educated manner, as a result of selecting one or more initiation points from a larger group of optional initiation points over a one and only charge used for activation of the interceptor (and in a manner that enables directing the interceptor's effect, and this, derived from the location of initiation over its activating charge).

Any professional would also understand that, similarly to system 13 illustrated in FIG. No. 1, as said, system 713 might also include a first sensor for early threat detection at a relatively long range from the protected object, and a second sensor for later threat detection at a relatively short range from the protected object, and in a manner that enables estimation of the threat's expected impact strike location at the object, and relative to array 716 and the position of the systems for quick arming and charge in accordance with the innovation, and the interceptors associated with them within. Also similarly to system 13 illustrated in FIG. No. 1, system 713 might also include control means, which from the instant of early threat detection, commands in a selective manner, the removal of first barrier means in one or more of the quick arming systems (see for example, the state illustrated in FIG. No. 8). From the instant of later threat detection, the control means commands the removal of second barrier means in the systems for quick arming in a selective manner—but in systems for quick arming, one or more, wherein the interceptor, executable by them, is appropriate for intercepting the threat (the state illustrated in FIG. No. 9). Also similarly to system 13 illustrated in FIG. No. 1, system 713 might also include central capacitor means commanded by a control means, and connected to the systems for quick arming in accordance with the invention, in a manner that from the instant of early threat detection, the control means also commands charging of the central capacitor, in a manner that will enable electric activation through it at short delay or at no delay, of a pyrotechnic thrust means whose activation leads to the irreversible removal, as said, of the second barrier means in the systems for quick arming in accordance with the invention, one or more, which will be chosen, as said, selectively.

Any professional would understand that in the manner of operation of active protection system 713, is also expressed a general method for quick arming of detonation or excitation assemblies, which are installed in the active protection system for operating interceptors of the protection system. A method that comprises the steps of assigning each one of the interceptors to at least one of the systems for quick arming (in the illustrated example—systems 720-1, 720-2, 720-3 and 720-4), and in a manner that the interceptor is executable by it. A step of early threat detection at a relatively long range from the object protected by the protection system and a step of removing first barrier means in at least one or more of the systems for quick arming by an electro-mechanical means (the steps which are illustrated in FIG. No. 8). A step of later threat detection at a relatively short range from the object protected by the protection system and a step of removing second barrier means in the system for quick arming selectively—but in systems for quick arming, one or more, wherein the interceptor, executable by them, is appropriate for intercepting the threat, and through pyrotechnic thrust means (the state illustrated in FIG. No. 9). The method might include an additional step of arming a central capacitor means, from the instant of early threat detection, as said, in a manner that will enable electric activation through it, of a pyrotechnic thrust means, in one or more systems, that will be chosen, as said, selectively (a step which is also illustrated in FIG. No. 9).

Thus, any professional will appreciate the advantages embodied in the implementation of systems for quick arming in accordance with the invention, in an active protection system—the implementation enables subjugation of the detection sensors' systems which are usually installed in such protection systems, as independent sensors (for example—radar type sensors, infrared detectors, optical cell arrays and ballistic-impact contact net shaped sensors). All this and more, implementing systems for quick arming in accordance with the invention, in an active protection system, provides an appropriate solution for the very short time challenge (less than 1 millisecond), which is subject to derive a "decision" regarding the predicted strike location of the threat and arming for action the detonation or excitation assemblies of the protection system's interceptors (a consequence of the position of the decisive sensor for detection in a relatively short range from the protected object and close to the object's side wall).

Indeed, systems for quick arming in accordance with the invention, in its preferred configuration which has been described hereinabove while referring to the accompanying figures, make use of pyrotechnic degradable components to ensure the quick arming, but this irreversible outcome takes place only after a confirmed detection of the threat as such that indeed, might hit the object (through the second and decisive sensor).

Systems for quick arming in accordance with the invention enable arming and selective initiation as required for activating specific interceptors from all of the protection system's interceptors—only those for which there is a high success probability of their action against the specific threat.

Implementation of systems in accordance with the invention also enables avoiding the need of full arming over time of all of the detonation or excitation assemblies, which are installed in an active protection system, in a manner that might expose all of them to involuntary execution and retire the whole arming system from use given such execution.

The central control means in an active protection system, in which systems for quick arming, in accordance with the invention, were implemented, might provide advantages of central arming and initiation. From the instant of early threat detection (receiving indication from the first sensor), the central control means commands the removal of first (reversible) barrier means in all of the systems for quick arming, which are located in the sector that might be threatened. At the same time, central capacitor means which is commanded by the central control means and connected to such systems for quick arming of detonation or excitation assemblies, is directly charged in a manner that will enable electric activation through it, of a pyrotechnic means whose activation will lead to the irreversible removal, as said, of second barrier means in the one or more systems, which is chosen as said, selectively, given threat confirmation and its predicted impact strike location (based on receiving indication from the second sensor). Any professional would also understand that a second central control means, linked to central capacitor means as said, also enables activation of the initiation chain (one or more), as required for activating an interceptor (one or more), and this—at a timing that fits the speed of the threat approaching the protected object.

In such a scenario, some of the systems in accordance with the invention are armed in an irreversible manner, and are ready for initiation to intercept the current threat, some of the systems might remain armed in a reversible manner in case that the estimation of the expected strike location changes (in other words—remain "in alert" at a stand-by state), and other systems were returned from a reversible-armed state to a secured (safety-locked) state, following clarification of the threat estimation, according to which it has been determined that they are no longer required as potential for intercepting the current threat, and the rest of the systems remained all of the time in a secured (safety-locked) state, since they were not required for interception of the current threat to begin with.

Thus, implementation of systems for quick arming in accordance with the invention provides operational flexibility and shortened reaction times while keeping high safety and survivability of the system in which such systems for arming are implemented.

Having described above several aspects of at least one embodiment, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

The invention claimed is:

1. A quick-arming excitation assembly, comprising:

an initiation chain comprising a first segment and at least one additional segment;

a slider comprising the first segment of the initiation chain and movable along a path, the slider movable between an on-line position wherein the first segment is aligned with the at least one additional segment along a common axis and the initiation chain is ready for full activation, and an off-line position wherein the first segment is separated from the common axis by a distance such that activation of one segment of the initiation chain is insufficient to cause full activation;

a first barrier; and a second barrier;

wherein the quick-arming excitation assembly is movable between a safe state, a stand-by state, and an armed state;

wherein the safe state of the quick-arming excitation assembly comprises the slider in the off-line position and the first and second barriers positioned on the path such that movement of the slider into the on-line position is blocked by the first and second barriers;

wherein the stand-by state of the quick-arming excitation assembly comprises the slider in the off-line position, the first barrier outside of the path, the second barrier in the path such that movement of the slider into the on-line position is blocked by the second barrier;

wherein the armed state of the quick-arming excitation assembly comprises the slider in the on-line position, the first barrier outside of the path;

wherein the quick-arming excitation assembly is reversibly movable between the safe state and the stand-by state; and wherein the quick-arming excitation assembly can be irreversibly driven from the stand-by state to the armed state once.

2. The quick-arming excitation assembly of claim 1, wherein the second barrier is a shear pin, and wherein moving from the stand-by state to the armed state comprises shearing the second barrier.

3. The quick-arming excitation assembly of claim 1, further comprising a solenoid coupled to the first barrier, wherein the activation of the solenoid with an electric charge drives the assembly from the safe state to the stand-by state by moving the first barrier out of the path.

4. The quick-arming excitation assembly of claim 3, further comprising a return spring coupled to the solenoid and biasing the assembly toward the safe state such that when the electric charge is removed the first barrier is driven back into the path by the return spring and the assembly is driven back into the safe state.

5. The quick-arming excitation assembly of claim 3, wherein the solenoid is a rotary solenoid.

6. The quick-arming excitation assembly of claim 1, further comprising a pyrotechnic thrust unit that is electrically powered and positioned along the path and configured to thrust the slider from the off-line position to the on-line position and irreversibly drive the assembly from the stand-by state to the armed state.

7. The quick-arming excitation assembly of claim 6, wherein the armed state further comprises a front end of the slider deformed and trapped inside a housing, maintaining the slider in the on-line position.

8. The quick-arming excitation assembly of claim 6, wherein the pyrotechnic thrust unit is configured to irreversibly drive the assembly from the stand-by state to the armed state in less than 1 millisecond.

9. A quick-arming excitation assembly system, comprising:

a first sensor;

a second sensor;

at least one quick-arming excitation assembly, each comprising:

an initiation chain comprising a first segment and at least one additional segment;

a slider comprising the first segment of the initiation chain and movable along a path, the slider movable between an on-line position wherein the first segment is aligned with the at least one additional segment along a common axis and the initiation chain is ready for full activation, and an off-line position wherein the first segment is separated from the common axis by a distance such that activation of one segment of the initiation chain is insufficient to cause full activation;

a first barrier; and a second barrier;

and a central control communicatively coupled to the first sensor, the second sensor, and the at least one quick-arming excitation assembly;

wherein each of the at least one quick-arming excitation assembly is movable between a safe state, a stand-by state, and an armed state;

wherein the safe state of each quick-arming excitation assembly comprises the slider in the off-line position and the first and second barriers positioned on the path such that movement of the slider into the on-line position is blocked by the first and second barriers;

wherein the stand-by state of each quick-arming excitation assembly comprises the slider in the off-line position, the first barrier outside of the path, the second barrier in the path such that movement of the slider into the on-line position is blocked by the second barrier;

wherein the armed state of each quick-arming excitation assembly comprises the slider in the on-line position, the first barrier outside of the path;

wherein each quick-arming excitation assembly is reversibly movable between the safe state and the stand-by state; and wherein the quick-arming excitation assembly can be irreversibly driven from the stand-by state to the armed state once.

10. The quick-arming excitation assembly system of claim 9, wherein the first sensor is a long range sensor, and the second sensor is a short range sensor having a range shorter than the first sensor.

11. The quick-arming excitation assembly system of claim 10, wherein the first sensor is radar, and the second sensor is an array of photoelectric cells.

12. The quick-arming excitation assembly system of claim 10, wherein at least one of the at least one quick-arming excitation assembly is driven from the safe state to the stand-by state by the central control in response to the reception of a first signal from the first sensor, and further driven from the stand-by state to the armed state in response to the reception of a second signal from the second sensor after the reception of the first signal from the first sensor.

13. The quick-arming excitation assembly system of claim 10, further comprising a capacitor communicatively coupled to the thrust unit of each of the at least one assembly, through the central control, wherein the central control begins charging the capacitor in response to the receipt of a first signal from the first sensor, and wherein at least one thrust unit is activated by the capacitor in response to the receipt of a second signal from the second sensor.

14. The quick-arming excitation assembly system of claim 9, wherein, for each of the at least one assembly, the second barrier is a shear pin, and wherein moving from the stand-by state to the armed state comprises shearing the second barrier.

15. The quick-arming excitation assembly system of claim 14, each of the at least one assembly further comprising a return spring coupled to the solenoid and biasing the assembly toward the safe state such that when the electric charge is removed the first barrier is driven back into the path by the return spring and the assembly is driven back into the safe state.

16. The quick-arming excitation assembly system of claim 14 wherein, for each of the at least one assembly, the solenoid is a rotary solenoid.

17. The quick-arming excitation assembly system of claim 9, each of the at least one assembly further comprising a solenoid coupled to the first barrier, wherein the activation of the solenoid with an electric charge drives the assembly from the safe state to the stand-by state by moving the first barrier out of the path.

18. The quick-arming excitation assembly system of claim 9, each of the at least one assembly further comprising a pyrotechnic thrust unit that is electrically powered and positioned along the path and configured to thrust the slider from the off-line position to the on-line position and irreversibly drive the assembly from the stand-by state to the armed state.

19. The quick-arming excitation assembly system of claim 18 wherein, for each of the at least one assembly, the armed state further comprises a front end of the slider deformed and trapped inside a housing, maintaining the slider in the on-line position.

20. The quick-arming excitation assembly system of claim 18 wherein, for each of the at least one assembly, the pyrotechnic thrust unit is configured to irreversibly drive the assembly from the stand-by state to the armed state in less than 1 millisecond.

* * * * *